United States Patent [19]

Csüdör

[11] 4,134,352

[45] Jan. 16, 1979

[54] DECORATIVE TEXTILE, METHOD FOR MANUFACTURE THEREOF AND SEWING MACHINE ATTACHMENT THEREFOR

[75] Inventor: Rosa Csüdör, Therwil, Switzerland

[73] Assignees: Irene Jahn-Csüdör; Irene Fuzesi-Kurtos, both of Therwil, Switzerland

[21] Appl. No.: 815,212

[22] Filed: Jul. 13, 1977

[51] Int. Cl.[2] ..... D05C 17/00

[52] U.S. Cl. ..... 112/262; 112/411

[58] Field of Search ..... 112/411, 412, 9, 262, 112/265

[56] References Cited

U.S. PATENT DOCUMENTS

| | | | |
|---|---|---|---|
| 1,946,853 | 2/1934 | Hollister | 112/9 |
| 2,120,687 | 6/1938 | Tarson | 112/9 X |
| 2,126,551 | 8/1938 | Haymaker | 112/9 |
| 2,223,951 | 12/1940 | Cumador | 112/9 X |
| 2,311,575 | 2/1943 | Robinson | 112/9 X |
| 2,507,907 | 5/1950 | Kanehl | 112/9 |

*Primary Examiner*—Werner H. Schroeder
*Attorney, Agent, or Firm*—Thomas W. Speckman

[57] ABSTRACT

A decorative textile having loose thread ends wherein the sewing holding the thread sections together or hold the thread sections to a flat base textile is covered by the loose thread ends. The decorative textile is produced by winding a flat coil form having an open slot with thread such that the open slot is at least partially covered with the thread windings, stitching the thread winding on a sewing machine through the slot, cutting the thread windings on both sides of the coil form thereby exposing the loose thread ends, and removing the decorative textile from the coil form. The decorative textile may be produced with or without the fabric base support. Various designs, defined by the open slots, may be applied to a fabric base. A sewing machine accessory to produce the decorative textiles is disclosed.

5 Claims, 9 Drawing Figures

DECORATIVE TEXTILE, METHOD FOR MANUFACTURE THEREOF AND SEWING MACHINE ATTACHMENT THEREFOR

This invention relates to a method for manufacturing a decorative piece of textile, in which a flat coil form having an opening is provided with a thread winding so that the opening is covered at least in part, and in which the thread winding is sewn with the help of a sewing machine in the proximity of the opening and the sewn thread winding is removed from the flat coil form.

It is a known practice in the manufacture of a decorative piece of textile, for instance a wall hanging or a pillow cover, to provide a flat basic piece of textile with colored decorative stitching with a sewing machine. On a piece of textile, the thread sections forming the decorative stitching then lie tight against the base piece of textile.

It is further a known practice to apply a one-layer thread winding on a two-pronged fork, to sew the winding between the fork prongs on a base piece of textile and to then withdraw the fork from the winding. By repeating this process, a piece of textile may be obtained, on which a flat base piece of textile is covered with parallel straight rows of closed thread loops arranged in the form of an "8".

To obtain straight lines of loops, a fork is used in the aforementioned method, in which the width of interspace between the prongs of the fork is only slightly greater than the diameter of the sewing needle. The latter may, at the same time, be used as a guide.

This method presents, however, the disadvantage that the stitching with which the thread loops are sewn down are very conspicuous and give an unesthetic effect. Moreover, there exists in the aforementioned process, a considerable danger of breakage of the needle during sewing.

As the basis of the invention there is, now, the problem of creating a method for producing with a sewing machine, by sewing on a thread winding, a decorative piece of textile with at least one row of short thread sections. The latter should be tufted enough that the stitching is no longer conspicuous.

The problem of the aforementioned kind, is solved by a method according to this invention, by the fact that the thread winding is cut open after sewing on both sides of the flat coil form.

The invention further includes an attachment for a sewing machine for carrying out the process with a pressure foot and a flat coil form for carrying a thread winding, provided with an opening. The attachment is characterized by the fact, according to a preferred embodiment of the invention, that the pressure foot is equipped with a pressure pad and that the opening is a slit with two at least approximately parallel longitudinal borders, with the width of the slit being such that the pressure foot pad extends into the slit in sewing position and provides a guide for the flat coil form.

The invention further includes a piece of textile manufactured according to the process. The piece of textile is characterized, according to the invention, by at least one row of thread sections sewn together in their middle zone and presenting loose ends on both sides.

The invention will now be described on the basis of preferred embodiments reprsented in the drawings wherein.

Figure 1:
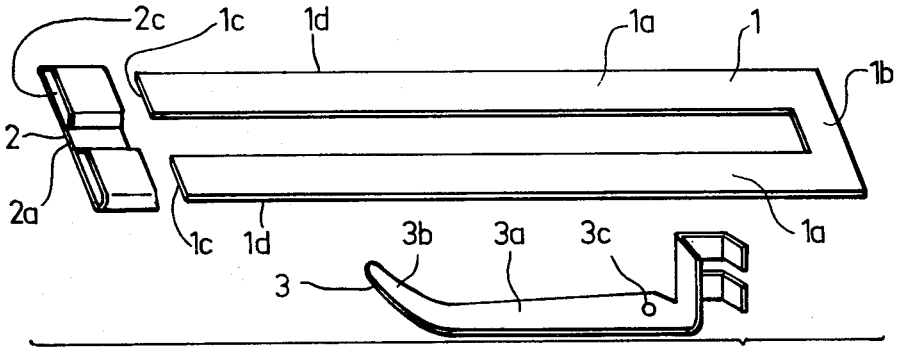
FIG. 1 shows, in dismantled state, parts of an attachment for a sewing machine in accordance with one embodiment of this invention.

In FIG. 1, 1 designates a U-shaped, somewhat elastically flexible bow with two parallel arms 1*a*, the ends of which are connected by bridge 1*b*, and the other ends 1*c* are free. The external edges of the two arms are 1*d*. Connecting element 2 has a flat middle section 2*a* and opposite end sections 2*b* bent towards each other defining, together with the middle section 2*a*, two flat openings 2*c*. In FIG. 1, there is further shown pressure foot 3. It is equipped with a pressure pad 3*a* with a free end 3*b* turned upwards. Pressure pad 3*a* is provided with bored hole 3*c* for the needle. Bow 1, the connecting element 2 and pressure foot 3 form the elements of the attachment for a sewing machine.

Figure 2:
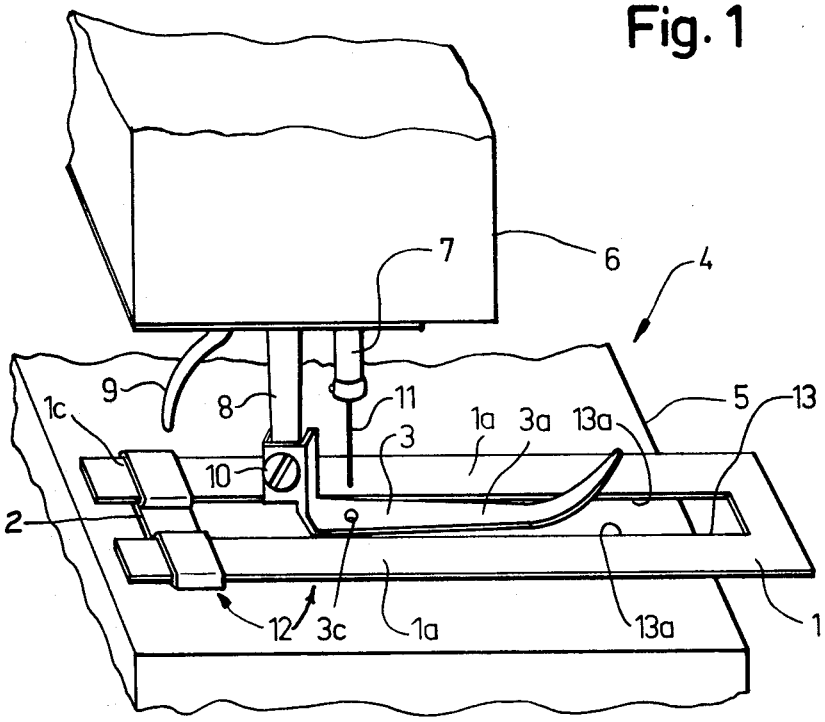
FIG. 2 is a perspective view of the attachment represented in FIG. 1 in assembled state on a sewing machine.

In FIG. 2, some parts of a sewing machine 4 are represented schematically. The table intended to bear the textiles to be sewn is represented by 5 and 6 represents the housing part in which needle bar 7 and the textile pressure bar 8 operate. Furthermore, there is a lever 9 for elevating and lowering the textile pressure bar 8. At the end of textile pressure bar, pressure foot 3 is fixed with screw 10 for detaching. The needle bar 7 holds needle 11. As may be seen from FIG. 2, the connecting element 2 may be slid over the free end sections 1*c* of the arms 1*a* of the bow 1. The connecting element 2 then connects the end sections 1*c* together in a detachable manner, providing stabilization of bow 1. Bow 1 and the connecting element 2 now form together flat coil form 12 with an opening in the form of a slot 13 with two parallel longitudinal edges 13*a*.

The length and width of the slot 13 are at least of the same length and width of the pressure pad 3*a* of the pressure foot 3. The slot is preferably somewhat wider than the pressure pad 3*a* of the pressure foot 3, so that the pressure pad 3*a* in sewing position provides a guide for the flat wound coil form 12 with some play to it.

In the following, it is now explained how decorative pieces of textile may be produced with the sewing machine 4 and the attachment of this invention.

Figure 3:
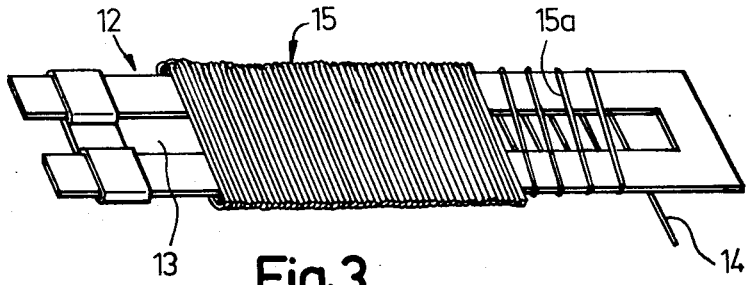
FIG. 3 is a perspective view of a flat coil form with a thread winding.

First, the pressure foot 3 is attached to the textile pressure rod 8 and the connecting element 2 is pushed onto bow 1 in the manner already described whereby the flat coil form is formed. On the flat coil form 12 thread 14 is now wound with a winding action as represented in FIG. 3, so that a dense thread winding 15 preferably of several layers is provided, covering the slot 13 at least partly, with the thread loops forming thread winding 15 and running at about a right angle to the longitudinal direction of the arms 1*a* and the slot 13. Any loose windings 15*a* are pushed tightly side by side or overlapping at the end of the winding process, and the free thread ends are pushed under the thread winding 15 or otherwise fastened.

Figure 4:
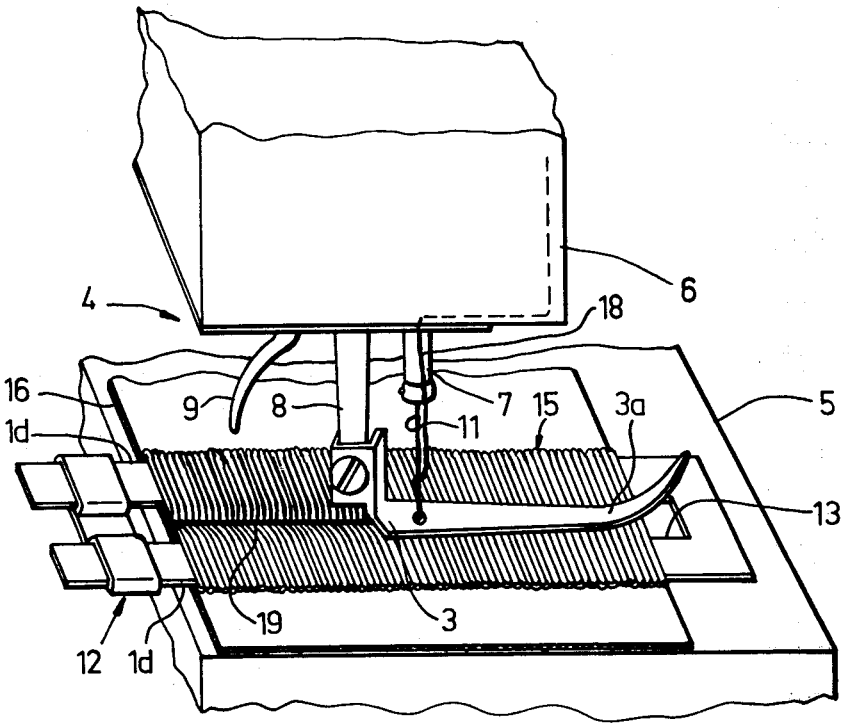
FIG. 4 is a perspective view of the attachment of this invention on a sewing machine sewing the thread winding.

As shown in FIG. 4, a flat base piece of textile 16 is laid on the table 5 of the sewing machine and the flat coil form 12 with the thread winding 15 is placed on the base piece of textile. Then the base piece of textile 16 and the flat coil form 12 are positioned under pressure foot 3 and the latter is lowered so that its pressure pad 3a enters the slit 13 or is at least extended into it and presses at least a part of the thread winding 15 against the base piece of textile 16. As already mentioned, there should be some space between the longitudinal edges 13a of the slot 13 and the pressure pad 3a so that the section of thread winding 15, on which the pressure pad 3a lies, may be pressed into the slot 13. Now the sewing machine is started and the thread winding 15 sewn on the flat base piece of textile 16 in the manner shown in FIG. 4 with a thread 18, thus forming the stitching 19. The base piece of textile 16 and the flat coil form 12 with the thread winding 15 are pushed together along the pressure pad 3a of the pressure foot 3, the latter guiding the flat coil form 12. When the thread winding 15 is sewn along its entire length, the base piece of textile 16 may be removed together with the flat coil form 12 from the area of the pressure foot 3. Then the connecting element 2 is again removed from the arms 1a and thereby separated from the arms 1a and from loop 1. Then the thread winding 15 is cut open with a knife along the two outer edges 1d of both loop arms 1a. Then bow 1 is removed.

Figure 5:
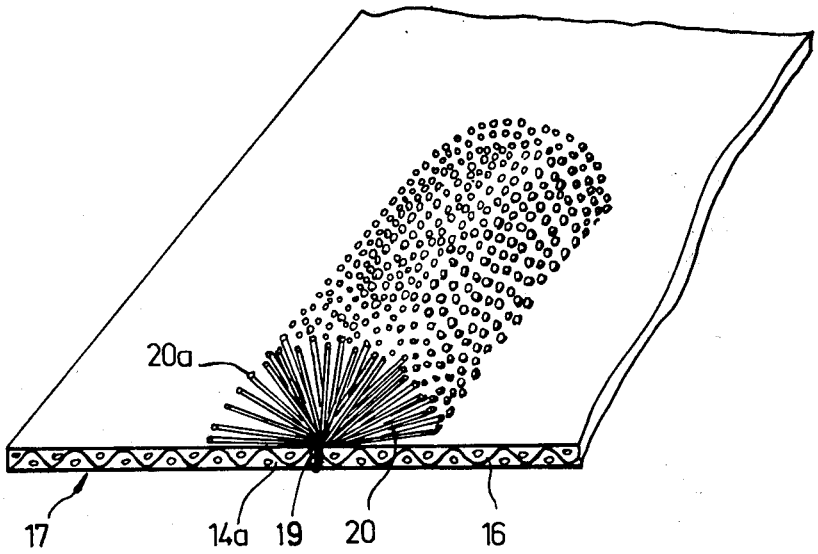
FIG. 5 is a section cut through a piece of textile with a decoration according to this invention.

With this method the decorative piece of textile 17 respresented in FIG. 5 may be produced, comprising a flat base piece of textile 16 and a decoration formed by a least one row of thread sections 20. These are sewn together in their middle and fastened by stitching 19 on the base piece of textile 16. The free ends 20a of the thread sections 20 stand out loosely from the base piece of textile 16. The thread sections 20 now form a dense tufted row, so that the stitching 19 is completely covered and concealed.

It is apparent that the method and the attachment may be modified. For instance, the flat coil form 12 may comprise, instead of a loop and a connecting element, of a one-piece, frame-shaped small plate.

In many cases it is desired to use the decorative piece without the fabric base support. This can be produced in the above described manner without using the base piece of textile 16. The resulting stringy structure tends to twist and turn. Experiments have shown that this undesirable behavior can be avoided if the free thread ends 14 are wound at least once at right angles to the thread winding 15, parallel to the longitudinal edges and the whole thing sewn through these longitudinal windings. The different tensions of the winding 15 are partially compensated by the transverse supplementary windings. If several threads are used simultaneously for the windings 15, the best results have been obtained when the thread ends 14 are twisted together before the thread ends are wound transversly and sewn as described.

Figure 6:
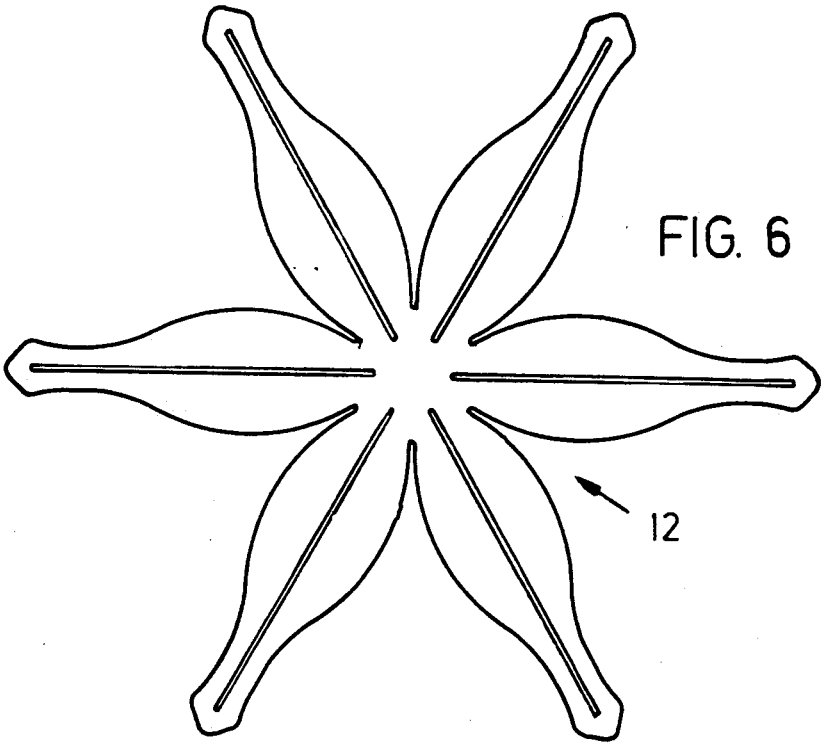
FIGS. 6–9 are other shapes of flat coil forms according to this invention.
Figure 7:
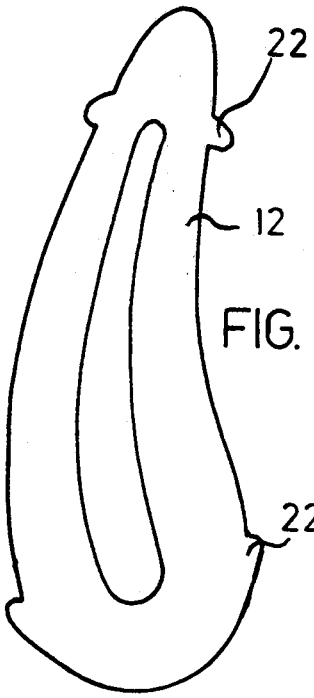
Figure 8:
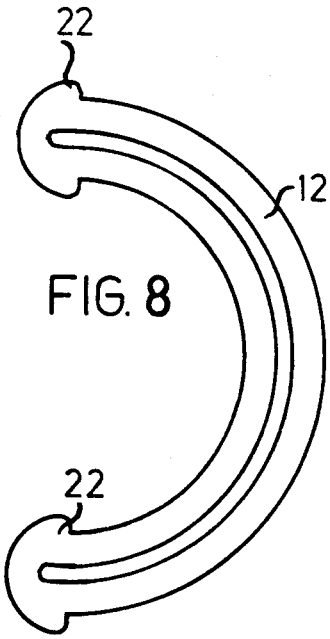
Figure 9:
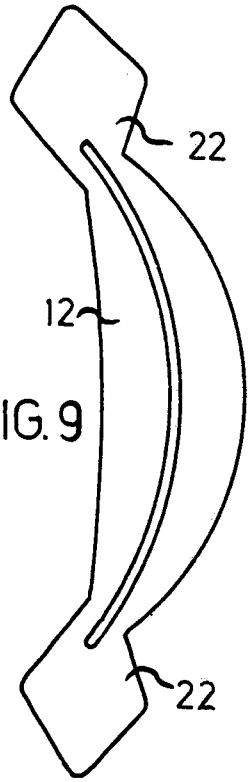

The flat coil form 12 may also be curved in the form of a sickle or other shape, so that curved rows of thread sections can also be formed. By this method, for instance, decorations with rosette or flower patterns may be formed. The slot of the flat coil form would then have to be curved correspondingly, with its edges running at least approximately parallel to one another, to provide a guide. If a pressure foot with a straight pressure pad is used, a fair free space should exist between the pressure pad protruding into the slot and the edges of the slot, so that the flat coil form 12 may be moved along a curve. It is, however, also possible to use a pressure foot the pressure pad of which is curved in the support plane corresponding to the curve of the slot. For the smaller, curved coil forms, as shown in FIGS. 6–9 in approximate actual size, it is no longer possible to make the width of the slot wide enough so that the pressure foot can be guided along the edge of the slot. This is not necessary with such short distances. It is only important to approximately anticipate the path of the slot. This is no problem, when the beginning and the end of the slot are visible. In addition, the coil forms in FIGS. 6–9 are so shaped that the area on which the thread can be wound is smaller than the length of the slot. In FIG. 6, the winding area is defined by the form. The flat coil forms in FIGS. 7–9 have projections before the ends of the slots which accurately define the thread-winding areas and keep the slot from being completely covered over.

By the method of this invention, quite a number of decorations may be produced. Naturally, not only the forms may vary, but multi-colored threads may be used. Furthermore, it is possible to use single or multi-strand threads.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A method of producing a decorative textile without fabric base support comprising; winding a flat coil form having an open slot with thread such that said open slot is at least partially covered with said thread windings the free thread end wound at least once perpendicular to said thread windings forming longitudinal windings, stitching said thread windings through said longitudinal windings on a sewing machine through said slot, cutting said thread windings on both sides of said coil form, and removing the decorative textile from the coil form the thread windings having been sewn together and the opposing loops formed thereby cut exposing loose thread ends.

2. The method according to claim 1, characterized by the fact that a flat coil form having a straight slot opening is used, the longitudinal edges of which are approximately parallel to each other and a pressure foot having a pressure pad is applied, the pressure pad extending upon the sewing of the thread winding, into the slot and guiding the flat coil form.

3. The method according to claim 1, characterized by the fact that the flat coil form is assembled before winding from a U-shaped bow having two arms connected at one end and a connecting element applied to the free ends of the arms, and that the connecting element is removed from the arms after sewing down the thread winding.

4. The method according to claim 1, characterized by the fact that two or more threads are used and the free thread ends are twisted together for the longitudinal windings.

5. The method according to claim 1, characterized by the fact that two or more threads are wound on the flat coil form simultaneously.

* * * * *